US009677165B2

(12) United States Patent
Saito et al.

(10) Patent No.: US 9,677,165 B2
(45) Date of Patent: Jun. 13, 2017

(54) FILM GROWING METHOD

(71) Applicant: MITSUBISHI HEAVY INDUSTRIES, LTD., Tokyo (JP)

(72) Inventors: Makoto Saito, Tokyo (JP); Noriyuki Hiramatsu, Tokyo (JP); Akira Fukushima, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/764,800

(22) PCT Filed: Dec. 16, 2013

(86) PCT No.: PCT/JP2013/083623
§ 371 (c)(1),
(2) Date: Jul. 30, 2015

(87) PCT Pub. No.: WO2014/129061
PCT Pub. Date: Aug. 28, 2014

(65) Prior Publication Data

US 2015/0368779 A1 Dec. 24, 2015

(30) Foreign Application Priority Data

Feb. 19, 2013 (JP) ..... 2013-030371

(51) Int. Cl.
*C23C 4/12* (2016.01)
*C23C 24/04* (2006.01)
(Continued)

(52) U.S. Cl.
CPC ..... *C23C 4/12* (2013.01); *C23C 4/02* (2013.01); *C23C 4/08* (2013.01); *C23C 24/04* (2013.01)

(58) Field of Classification Search
None
See application file for complete search history.

(56) References Cited

U.S. PATENT DOCUMENTS 5,203,944 A * 4/1993 Prinz ..... B23P 15/00 156/247
2006/0258055 A1* 11/2006 Okamoto ..... H01L 23/3735 438/124

(Continued)

FOREIGN PATENT DOCUMENTS

JP 7-62513 3/1995
JP 2007-197828 8/2007

(Continued)

OTHER PUBLICATIONS

International Search Report issued Mar. 18, 2014 in corresponding International Application No. PCT/JP2013/083623.

(Continued)

*Primary Examiner* — Michael Wieczorek
*Assistant Examiner* — Bradford Gates
(74) *Attorney, Agent, or Firm* — Wenderoth, Lind & Ponack, L.L.P.

(57) ABSTRACT

A film growing method includes: (A) attaching wall members to ends of a film grown surface of a base material; (B) growing a film on the film grown surface by a cold spray method; and (C) removing the wall members after a thickness of the grown film on the film grown surface becomes equal to a desired film thickness. It can be prevented that the side ends of the grown film are formed in a slope when a thick film is to be grown by using the cold spray.

4 Claims, 3 Drawing Sheets

(51) Int. Cl.
*C23C 4/02* (2006.01)
*C23C 4/08* (2016.01)

(56) References Cited

U.S. PATENT DOCUMENTS

| | | | | |
|---|---|---|---|---|
| 2007/0154641 | A1 | 7/2007 | Kobayashi | |
| 2012/0181685 | A1 | 7/2012 | Ohno | |
| 2012/0228776 | A1* | 9/2012 | Ohno | C23C 24/04 257/773 |

FOREIGN PATENT DOCUMENTS

| | | |
|---|---|---|
| JP | 2012-57203 | 3/2012 |
| WO | 2011/145202 | 11/2011 |

OTHER PUBLICATIONS

International Preliminary Report on Patentability issued Sep. 3, 2015 in corresponding International Application No. PCT/JP2013/083623.

Japanese Decision to Grant a Patent issued Oct. 5, 2016 in corresponding Japanese Patent Application No. 2013-030371 (with partial English translation).

* cited by examiner

FILM GROWING METHOD

CROSS-REFERENCE TO RELATED APPLICATION

The present application is based on Japanese Patent Application No. JP 2013-030371 filed on Feb. 19, 2013, and claims priority therefrom. The disclosure of JP 2013-030371 is incorporated herein by reference.

TECHNICAL FIELD

The present invention relates to a film growing technique using a cold spray method.

BACKGROUND ART

There is a case in which a thick film needs to be formed on a base material to manufacture a structure. For example, such a structure can be a combustion chamber of a rocket engine for aerospace. When the combustion chamber of the rocket engine is manufactured, a copper film having a film thickness equal to or more than 10 mm has to be formed on a copper base material.

As a method of forming such a thick metal film, "an electroplating method" is exemplified. However, a film growth rate by the electroforming method is very small, thereby taking several months to achieve a target film thickness of about 10 mm, for example.

To solve such a problem, the applicant of the present application proposed a technique of forming a metal thick film by using "a cold spray method", in JP 2012-057203. The cold spray method is a method in which a high speed flow of gas is formed to have a temperature lower than a melting point or softening temperature of material powder, particles of the material powder are injected into the gas flow and accelerated, and the material powder particles are made to collide with a base material in a solid phase state. The film forming rate in the cold spray method is much faster than that of the electroforming method. Therefore, a period of time taken to manufacture the structure can be substantially reduced by using the cold spray method.

The inventors of the present invention found through an experiment that the following problems occurred when a thick film was formed by the cold spray method. The problems will be described with reference to FIG. 1 and FIG. 2.

As shown in FIG. 1, a film 30 is formed by the cold spray method on a film grown surface 10A which is the upper surface of a base material 10. The material of the film 30 is Inconel 718 of a Ni-based material. At this time, the area of the grown film 30 at a position became smaller as the position moved away from a boundary with the base material 10. In other words, the side surfaces 30S of the grown film 30 were inclinedly formed into a direction of the center from the side ends 10E of the film grown surface 10A. That is, it was found that the side surfaces 30S of the grown film 30 were formed in "a slope".

FIG. 2 shows a case where the material of the grown film 30 is Cu. In this case, the area of the grown film 30 increased once and then decreased as it moved away from the boundary with the base material 10. It was found that the side surfaces 30S of the grown film 30 were still formed in "a slope" even in this case.

The phenomenon described above is not tangible in the case where a thin oxide film and so on is formed by the cold spray method and the problem is peculiar to the case where a thick film is formed by the cold spray method.

SUMMARY OF THE INVENTION

Therefore, one object of the present invention is to provide a technique by which it can be prevented that the side surfaces of the grown film are formed in a slope in the formation of the thick film by using the cold spray method.

In an aspect of the present invention, a film growing method is provided. The film growing method includes: (A) attaching wall members to ends of a film grown surface of a base material; (B) growing a film on the film grown surface by a cold spray method; and (C) removing the wall members after a thickness of the film grown on the film grown surface becomes equal to a desired film thickness.

According to the present invention, it can be prevented that the side surfaces of the grown film are formed in a slope when the thick film is formed by using the cold spray method.

DESCRIPTION OF EMBODIMENTS

Referring to the attached drawings, a film forming technique according to the embodiment of the present invention will be described.

Figure 3:
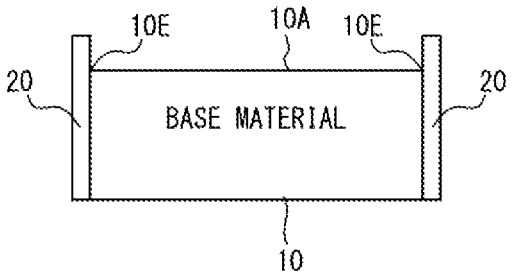
FIG. 3 is a conceptual diagram showing a film growing method according to an embodiment of the present invention.

A base material 10 shown in FIG. 3 is a film growth object. The surface of the base material 10 is a film grown surface 10A. As shown in FIG. 3, wall members 20 are attached to edge portions (lateral ends) 10E of the film grown surface 10A. Each wall member 20 is a member having a wall shape extending in a vertical direction, and the upper end of the wall member 20 protrudes upwardly from the film grown surface 10A. In other words, the wall members 20 are disposed so as to surround the circumference of the film grown surface 10A.

Figure 4:
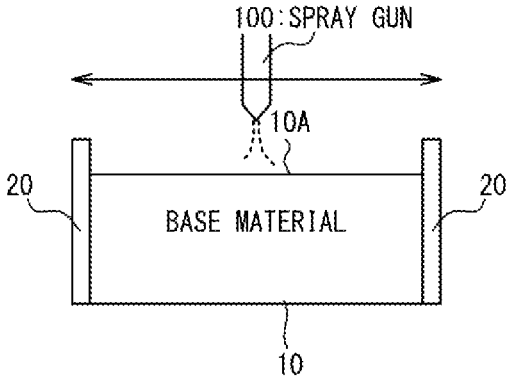
FIG. 4 is a conceptual diagram showing the film growing method according to the embodiment of the present invention.

Next, as shown in FIG. 4, a film growth is carried out on the film grown surface 10A by a cold spray method. In the cold spray method, by scanning a spray gun 100 fully while blowing material powder from the spray gun 100 to the film grown surface 10A, the film growth is carried out. When a structure such as a combustion chamber of a rocket engine is manufactured, the film growth of a metal film is typically carried out by spraying metal material powder. As such a metal material, Ni-based material like Inconel 718 and copper are exemplified.

Figure 5:
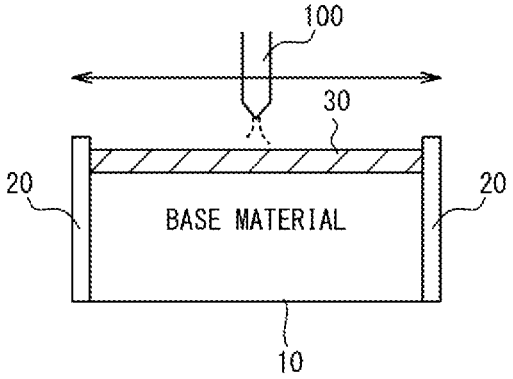
FIG. 5 is a conceptual diagram showing the film growing method according to the embodiment of the present invention.
Figure 6:
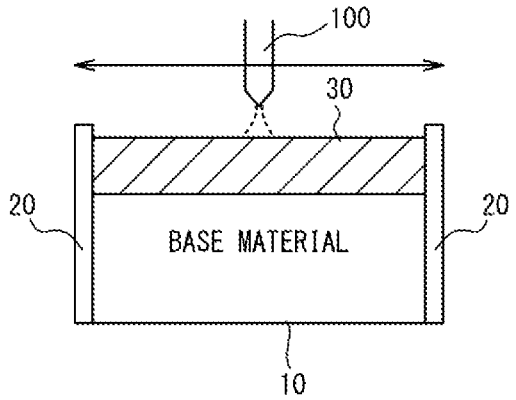
FIG. 6 is a conceptual diagram showing the film growing method according to the embodiment of the present invention.

As shown in FIG. 5, by scanning the spray gun 100 above the surface, the film 30 is grown on the film grown surface 10A. When the film thickness of the grown film 30 becomes thicker and the height of the wall member 20 becomes inadequate, an additional part is added to the wall member 20 as shown in FIG. 6.

Figure 7:
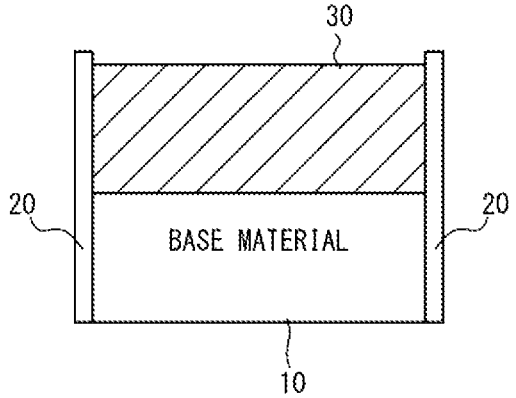
FIG. 7 is a conceptual diagram showing the film growing method according to the embodiment of the present invention.

Until the film thickness of the grown film 30 formed on the film grown surface 10A becomes a desired film thickness, the film growth processing is carried out. FIG. 7 shows a state in which the grown film 30 having the desired film thickness has been formed. When the manufacture of a structure (and not a simple film growth) is carried out, the desired film thickness is typically equal to or more than 1 mm. When the combustion chamber of the rocket engine is manufactured, the desired film thickness is typically equal to or more than 10 mm.

Figure 8:
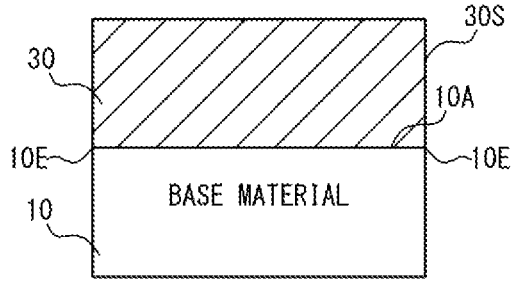
FIG. 8 is a conceptual diagram showing the film growing method according to the embodiment of the present invention.

After that, the wall members 20 are removed as shown in FIG. 8. Since the grown film 30 is attached firmly to the wall members 20, the wall members 20 are cut off through machine processing.

Figure 1:
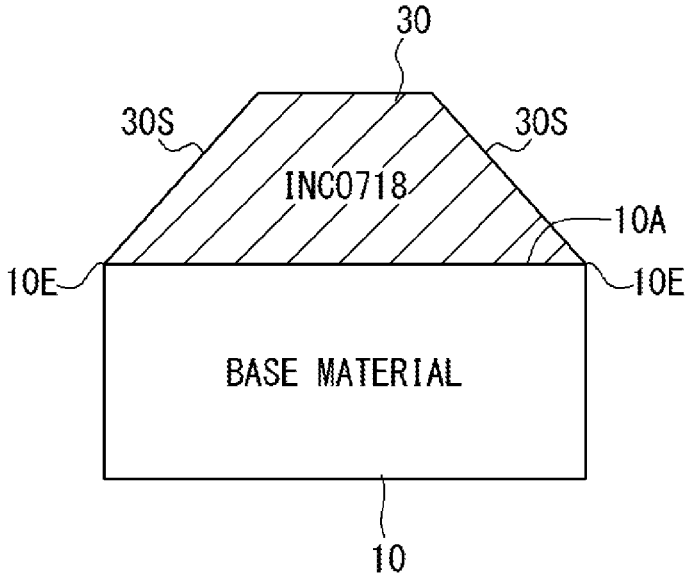
Fig. 1 PRIOR ART
FIG. 1 is a conceptual diagram showing a problem.
Figure 2:
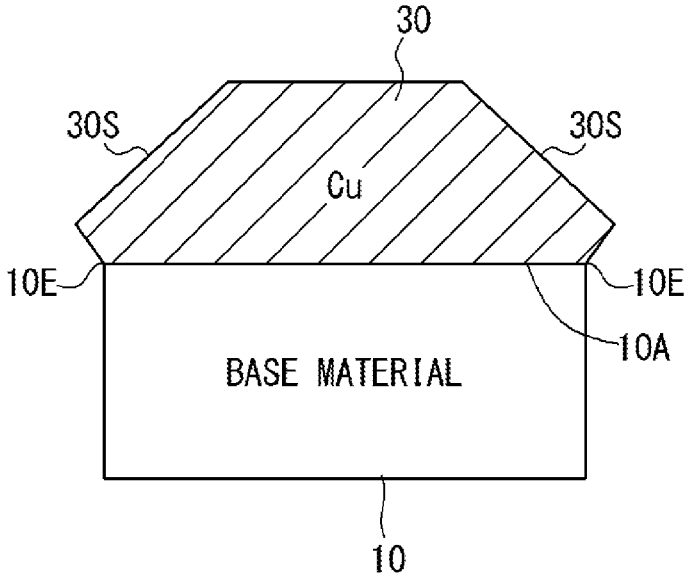
Fig. 2 PRIOR ART
FIG. 2 is a conceptual diagram showing another problem.

In this way, the film 30 is formed on the film grown surface 10A of the base material 10. It was confirmed that neither of the side surfaces 30S of the grown film 30 was an inclined surface as shown in FIG. 1 and FIG. 2 but a vertical surface formed along the shape of the corresponding wall member 20. The inventors of the present invention considered the reasons for this result as follows.

The cold spray method is a technique of growing a film by the particles of the material powder colliding at high speed. The binding strength of the grown film 30 is relatively strong in the vertical direction but is relatively weak in the horizontal direction. Therefore, when there are no wall members 20 on the lateral ends, the outermost layer of the grown film 30 comes off so that it is susceptible to fall under the base material 10. As a result, the side surfaces 30S of the grown film 30 are formed in a slope toward the center from the lateral ends 10E of the grown film object surface 10A, as shown in FIG. 1.

On the other hand, in the present embodiment, the wall members 20 are attached to the lateral ends 10E of the film grown surface 10A. Therefore, it can be prevented that the outermost layer of the grown film 30 comes off and falls below the base material 10. As a result, the side surfaces 30S of the grown film 30 are not formed in a slope but are vertically formed along the wall members 20.

As described above, according to the present embodiment, it can be prevented that the side surfaces of the grown film 30 are formed in a slope in a thick film growth by using the cold spray method. It becomes more desirable to apply the present embodiment as the desired film thickness becomes thicker.

In the disclosure above, the embodiments of the present invention have been described with reference to the drawings. However, the present invention is not limited to the above-mentioned embodiments and can be appropriately changed or modified by a person skilled in the art in a range not deviating from the scope of the present invention.

The invention claimed is:

1. A film growing method comprising:

attaching wall members to lateral side surfaces of a base material to extend upwardly from a film grown surface on the base material;

growing the film on the film grown surface by a cold spray method while further extending the wall members upwardly; and removing the wall members after a thickness of the film grown on the film grown surface becomes equal to a desired film thickness.

2. The film growing method according to claim 1, wherein the grown film comprises a metal film grown by the cold spray method.

3. The film growing method according to claim 1, wherein the desired film thickness is equal to or more than 1 mm.

4. The film growing method according to claim 1, wherein the desired film thickness is equal to or more than 10 mm.

* * * * *